US006116530A

United States Patent [19]

Altmayer et al.

[11] Patent Number: 6,116,530

[45] Date of Patent: Sep. 12, 2000

[54] ADAPTER FOR ROCK CRUSHER

[75] Inventors: Richard Altmayer; Joseph Altmayer, both of Kitchener, Canada

[73] Assignee: E & E Seegmiller Limited, Kitchener, Canada

[21] Appl. No.: 09/336,683

[22] Filed: Jun. 21, 1999

[51] Int. Cl.[7] ..... B02C 1/04

[52] U.S. Cl. ..... 241/264

[58] Field of Search ..... 241/264–269, 241/207–216

[56] References Cited

U.S. PATENT DOCUMENTS 4,016,630 4/1977 Bengtsson et al. ..... 241/207

4,927,089 5/1990 Altmayer ..... 241/264

5,765,769 6/1998 Kaya ..... 241/268

*Primary Examiner*—Mark Rosenbaum

[57] ABSTRACT

A jaw crusher for crushing rocks combines a hydraulic adjustment of the bite with an air spring tensioning arrangement which maintains a desired tensile force even with variation of the bite. The air spring arrangement is reliable in the dirty environment and also has long life. The use of several air springs in combination with a pressure sensing arrangement adds a safety factor. The more consistent tensioning force allows adjustment of both the tensioning arrangement and the bite of the rock crusher during operation thereof.

8 Claims, 4 Drawing Sheets

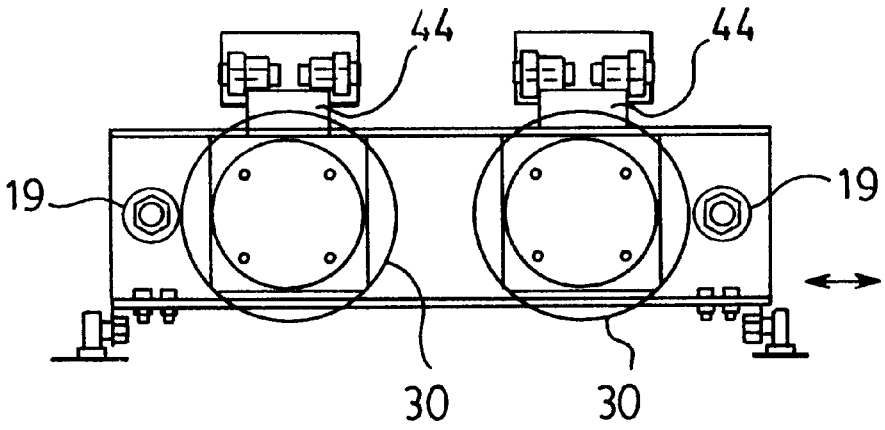
FIG. 6.
FIG. 7.
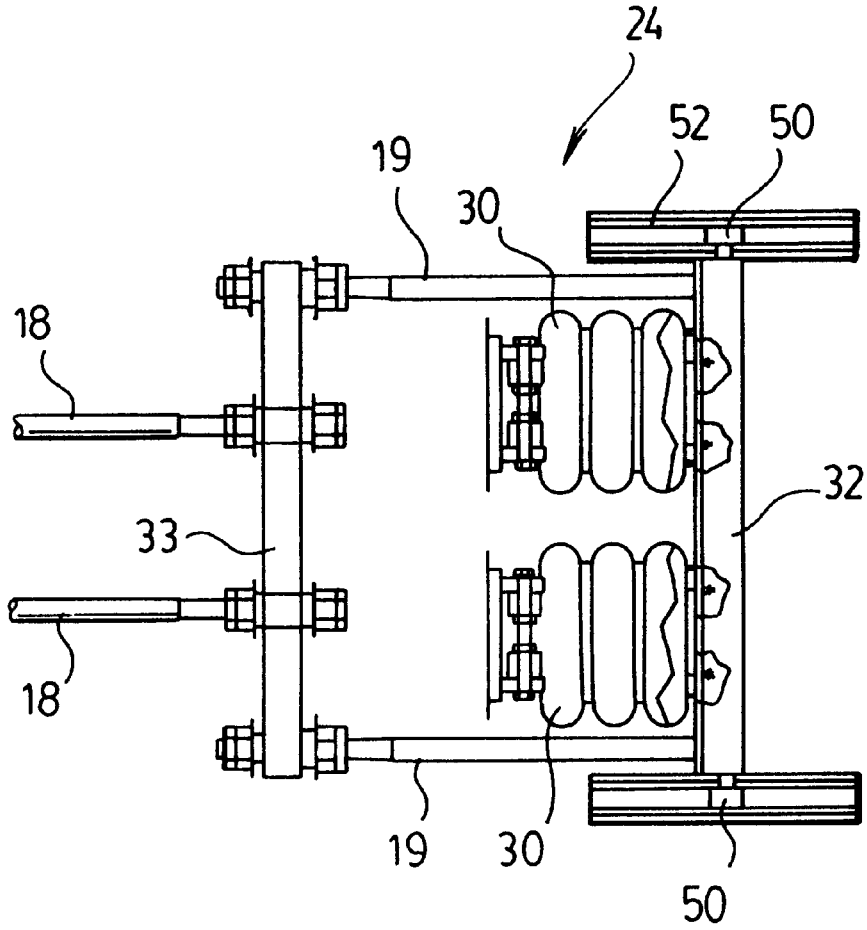

ADAPTER FOR ROCK CRUSHER

FIELD OF THE INVENTION

The present invention relates to jaw crushers for crushing rock and in particular, relates to an improved system for applying a tensile force to the tension rods of a jaw crusher.

BACKGROUND OF THE INVENTION

In conventional jaw crushers, a moving jaw is supported at its lower end by a plate type structure which is commonly known as a toggle plate. The upper end of the moving jaw is controlled by an elliptical drive, causing the jaw to move back and forth, relative to a fixed jaw. The jaw crusher can be a single toggle design or a double toggle design.

Our U.S. Pat. No. 4,927,089, which is incorporated herein by reference, discloses a hydraulic control system which replaces the rigid toggle plate of the prior art. This hydraulic control arrangement allows adjustment of the bite between the moving jaw and the fixed jaw. With the hydraulic control arrangement adjustment of the bite can be carried out during operation of the rock crusher. Such adjustment is desirable to maintain a desired throughput through the rock crusher, and this throughput varies as a function of the amount of material received and the type and size of the material. The adjustable bite provides the operator with an on the fly adjustment that directly affects the throughput of the rock crusher and also simplifies clearing of the rock crusher in the event of a non-crushable material becoming lodged in the bite.

The hydraulic ram disclosed in our patent is a double acting arrangement and includes a safety relief arrangement in the event of a non-crushable material being encountered.

Adjustment of the hydraulic control arrangement to vary the bite also varies a tensioning arrangement of the jaw crusher. The tensioning arrangement includes two coil springs used to apply a force on tension rods of the rock crusher attached near the base of the movable jaw. Although it would be desirable to have a constant tensioning force, adjustment of the hydraulic cylinders causes a change in the tensioning force. This can be corrected by manually adjusting adjustment nuts at the end of the tension rods, however, this is typically not practical with the rock crusher in operation. There have been proposals to use hydraulic cylinders for maintaining a constant tensioning force, however, these systems often have not proven entirely satisfactory, and appreciably add to the cost of the system.

SUMMARY OF THE INVENTION

A jaw crusher for crushing rock, according to the present invention, has a fixed jaw mounted on a frame and a moveable jaw mounted on the frame and connected to a drive for cyclical movement of the moveable jaw toward and away from the fixed jaw. The moveable jaw and the fixed jaw adjacent a lower edge of the moveable jaw are spaced and define a bite therebetween. The bite between the jaws is variable by adjusting a double acting hydraulic cylinder extending between the lower edge of the moveable jaw and the frame. The hydraulic cylinder arrangement allows movement of the movable jaw from a narrow bite position between the jaws to an open bite position which allows removal of obstructing material between the jaws. The jaw crusher further includes a tensioning arrangement for biasing the moveable jaw against the double acting hydraulic cylinder and accommodating the cyclical movement of the moveable jaw. The tensioning arrangement includes at least one tensioning rod having one end thereof connected to the lower edge of said moveable jaw and an opposite end cooperating with a biasing member applying a tensile force on said at least one tensioning rod to bias said moveable jaw where the biasing member is an air spring structure.

According to an aspect of the invention, the air spring structure includes at least two air springs.

According to a further aspect of the invention, each air spring includes an auxiliary pressure vessel connected to pressurize the air spring to modulate the operating pressure of said air spring while accommodating the cyclical movement of said air springs in sympathy with the cyclical movement of said moveable jaw.

According to yet a further aspect of the invention, two spaced tensioning rods are provided with the ends of said tensioning rods remote the removable jaw being connected by a yoke arrangement biased by said air spring structure. The air spring structure applies the bias force to said tensioning rods using said common header as an intermediary transfer member.

According to yet a further aspect of the invention, the header includes a support structure accommodating movement of the header generally along the longitudinal axis of the tension rods and supporting the header against downward pivoting movement.

According to yet a further aspect of the invention, the air spring structure includes two side by side air springs acting on said header and located in a non coaxial manner relative to such tension rods.

According to yet a further aspect of the invention, each air spring is connected to an air pressure supply vessel that modulates the operating pressure of the air spring regardless of the bite position of said moveable jaw.

BRIEF DESCRIPTION OF THE DRAWINGS

Preferred embodiments of the invention are shown in the drawings, wherein:

FIG. 6 is an end view of the embodiment of FIG. 4; and

FIG. 7 is a top view showing an alternate air spring tensioning arrangement.

DETAILED DESCRIPTION OF THE PREFERRED EMBODIMENTS

Figure 1:
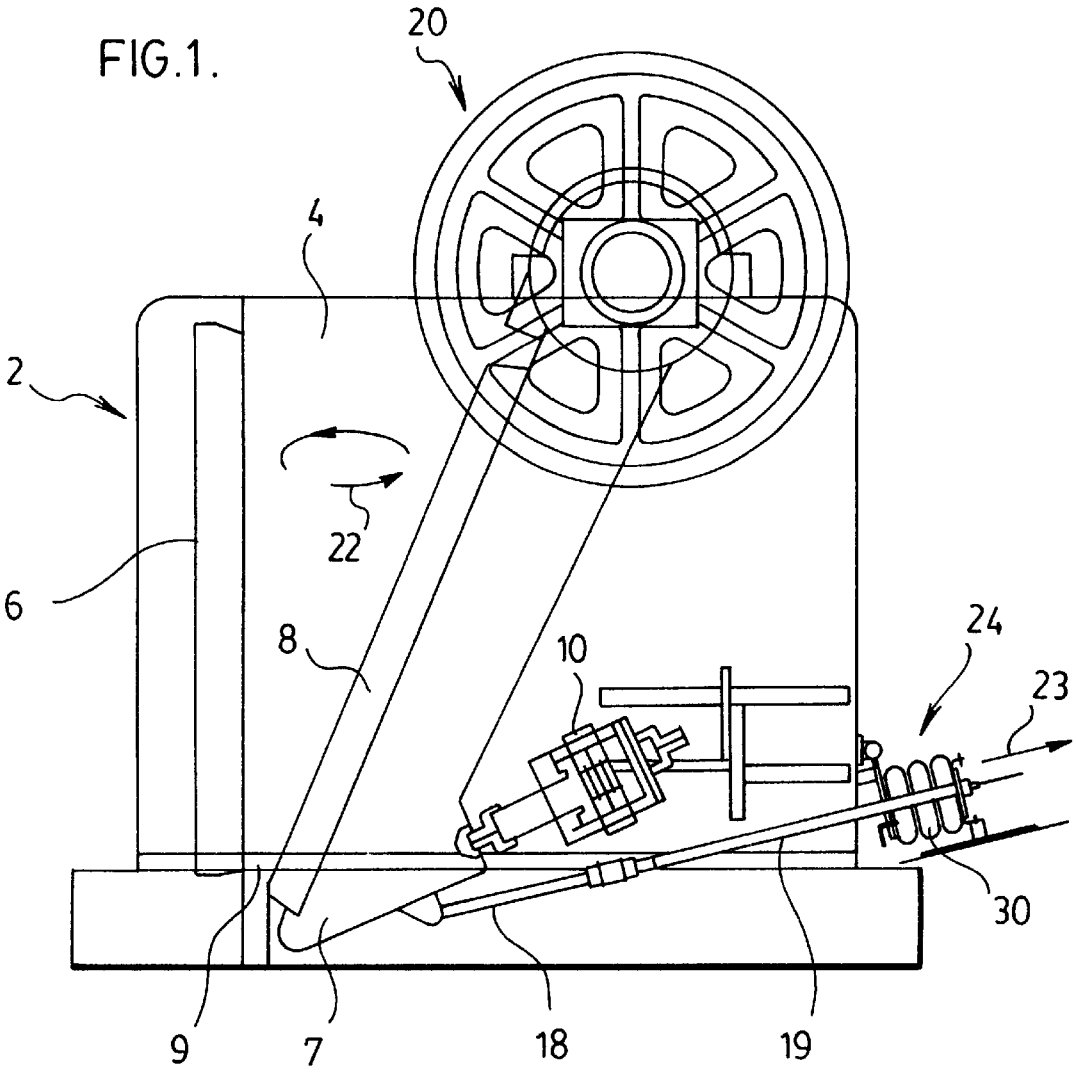
FIG. 1 is a schematic side elevation showing the rock crusher with a narrow bite.
Figure 2:
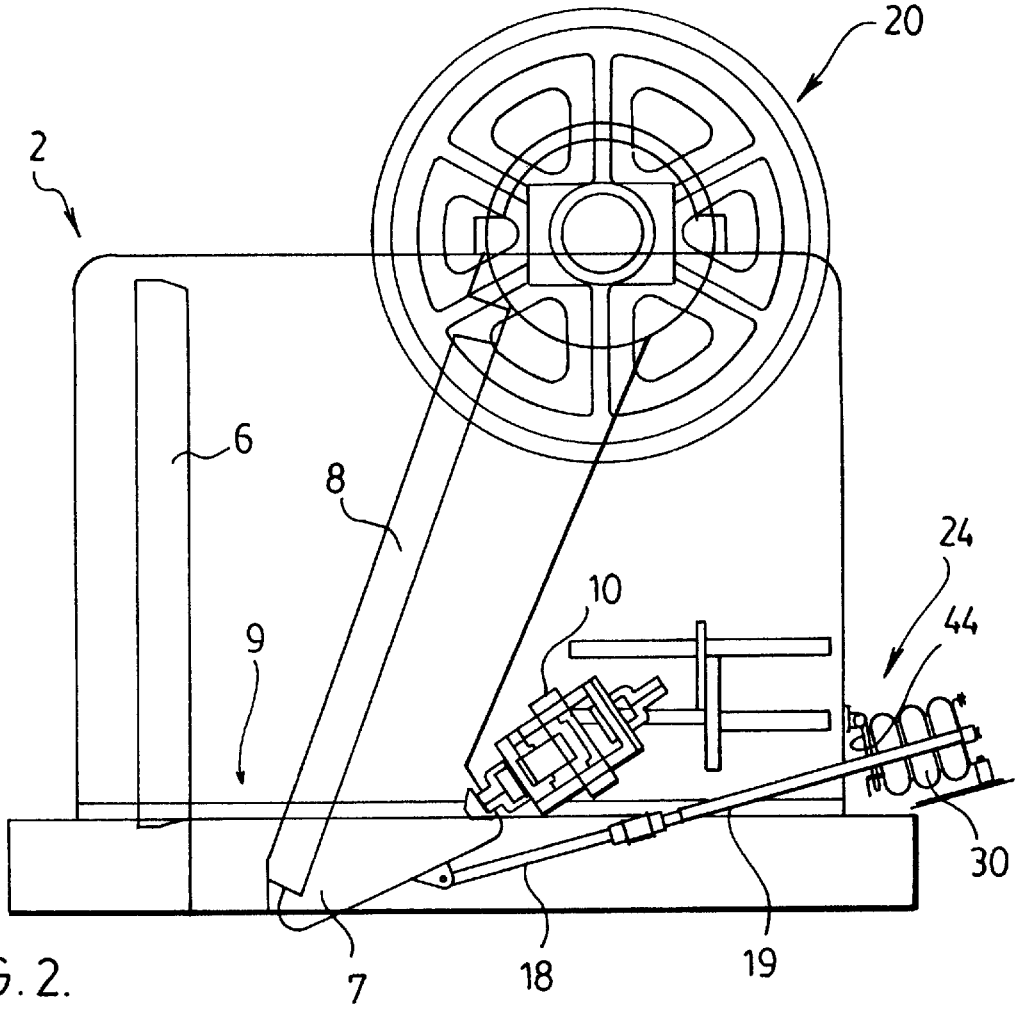
FIG. 2 is the view similar to FIG. 1, with the jaws in an open position.
Figure 3:
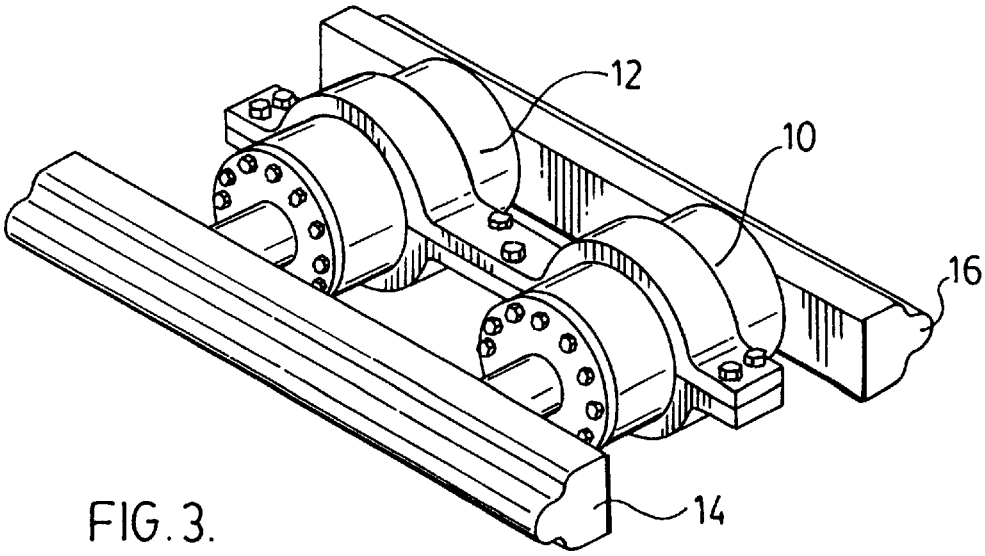
FIG. 3 is a schematic perspective view of the double acting hydraulic cylinder arrangement.

The jaw crusher 2, schematically shown in FIGS. 1 and 2, is of a single toggle design and has a frame 4, a fixed jaw 6 and a moveable jaw 8. A bite 9 which is the spacing between the moveable jaw and the fixed jaw, is controlled by the double acting hydraulic cylinders 10 and 12. It can be seen that one end of these double acting hydraulic cylinders is lodged against the frame and the opposite end is in engagement with the lower edge of the moveable jaw. This double acting hydraulic cylinder arrangement as shown in FIG. 3, replaces a stationary toggle plate and wedge members of a conventional jaw crusher. Tension rods 18 extend rearwardly from the lower edge of the moveable jaw and cooperate with tensioning arrangements 24. The tensioning arrangement 24 includes tie rods 19 which form a continuation of the tension rods 18.

The eccentric drive 20 causes a cyclical movement of the moveable jaw 8 towards and away from the fixed jaw, as well as limited vertical motion. The double acting hydraulic cylinders, in combination with a nose bearing member 14 and the rear bearing member 16 accommodate this movement of the moveable jaw while maintaining a particular operating bite 9 between the moving jaw and the fixed jaw 6. During operation of the rock crusher, the operator can adjust the double acting hydraulic cylinders to vary the particular bite. It should be noted that some variation of the bite occurs due to the cyclical movement, but the size of the bite is controlled by the double acting hydraulic cylinders. The cyclical movement of the moveable jaw is indicated by the arrows 22. These are exaggerated, but generally describes the action.

Figure 4:
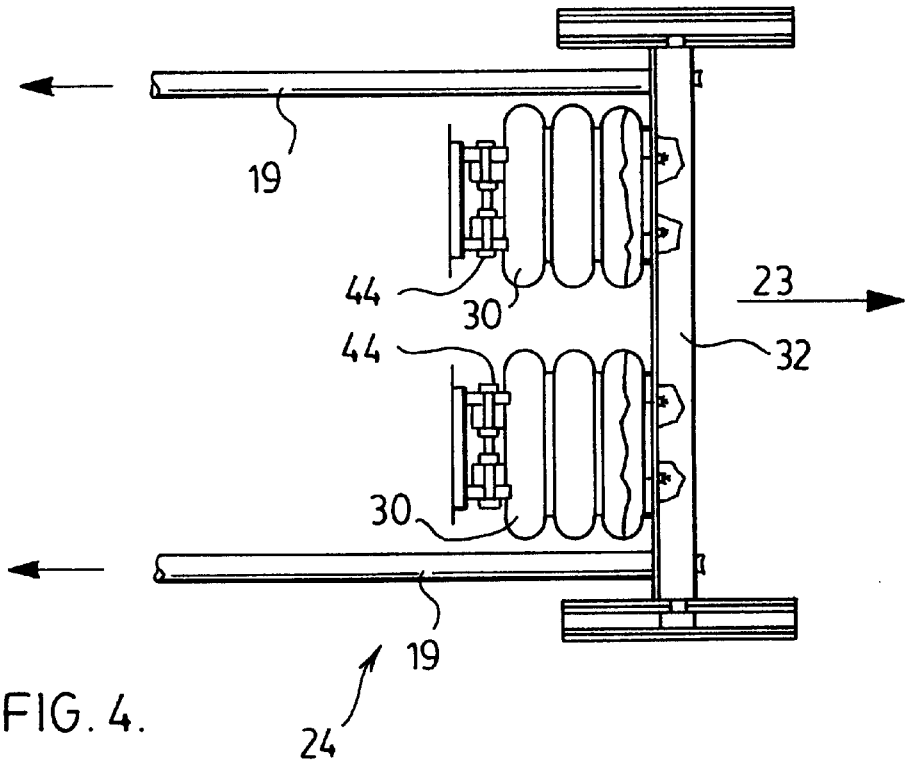
FIG. 4 is a partial top view showing the tensioning arrangement according to one embodiment.

The tensioning arrangement 24 applies a bias force, urging the lower edge 7 of the movable jaw to maintain contact with the hydraulic cylinders 10 and 12. The tensioning arrangement provides a net force on the tensioning rods 18, as indicated by the arrow 23. The tensioning arrangement as shown in FIG. 4 includes tie rods 19 attached to a header 32. The header 32 is biased in the direction 23 by air springs 30. The air springs contact a fixed part of the frame of the crusher bias the header 32. These air springs are positioned in a non-coaxial manner relative to the rods 19. This is in contrast to conventional coil springs which sleeve tension rods in a conventional rock crusher. The structure of the air spring is simplified by using an air spring which does not sleeve the tie rod. The tensioning arrangement with the header acting on each air spring serves to distribute the forces to both air springs.

Figure 5:
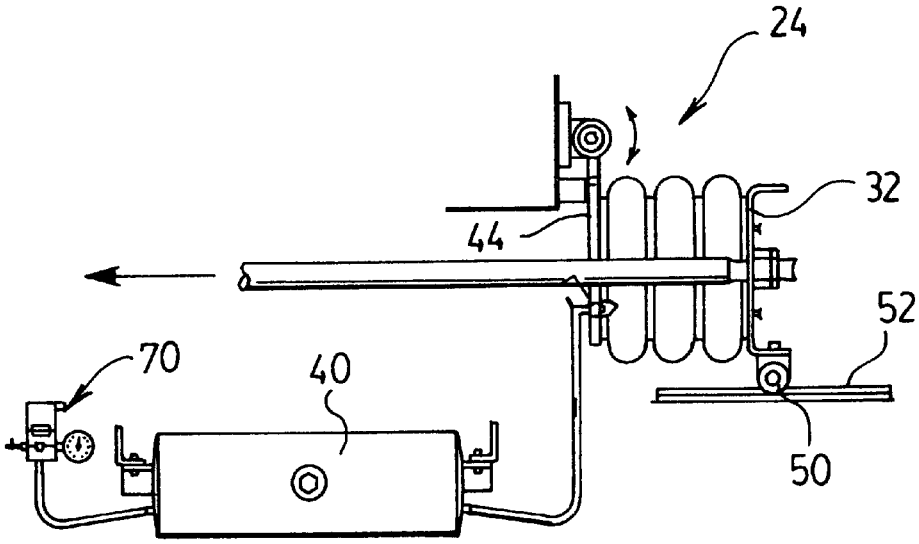
FIG. 5 is a partial side view showing the structure of FIG. 4.

FIGS. 5 and 6 show additional details of the tensioning arrangement of FIG. 4. The two tie rods 19 are connected by the common header member 32, which is mechanically fastened by bolts, for example, to the ends of the tie rods 19 as clearly shown in FIG. 5. The two air springs 30, each have three stages. Each air spring is located between the header and a hinged plate member 44 pivotally attached to the fixed frame of the crusher. The header also includes wheels 50 which move within the track 52 and support the tie rods 19 against downward pivoting movement. The cyclical movement of the moving jaw moves the header back and forth in the track 52. The actual extent of movement is smaller than the length of the track, however, the track has been sized to accommodate the various operating positions of the moveable jaw, which positions are controlled by the bite setting of the hydraulic cylinders.

As shown in FIG. 5, each air spring 30 is connected to an air supply tank 40. The air springs are maintained within a desired pressure range and the air tank 40 basically increases the volume of pressurized air and modulates the operating pressure, such that the cyclical movement of the moving jaw and the adjustable movement caused by the hydraulic cylinders will not produce wide variations in the operating pressure of the air springs. In this way, the tensioning force exerted by the air springs is within a desired range and is not unduly affected either by the particular bite set by the hydraulic cylinders, nor the cyclical movement of the moveable jaw. Fortunately, the air springs 30 are quite tolerant with respect to lateral misalignment, and therefore, the exact mounting structure of the air springs is not as critical.

FIG. 7 shows an alternate tensioning arrangement which can be used with a rock crusher having tension rods 18 generally centrally located, as opposed to either side of the rock crusher. An additional yoke 33 connects tension rods 18 to tie rods 19. The location of the tension rods and the number of tension rods vary depending on the manufacturer. The header arrangement allows the position and number of tension rods to remain the same. Typically, for a retrofit application, the tension rods are shortened or replaced, however, the location of the connection to the removable jaw remains unchanged. Shortening of the tension rods allows locating of the air springs in the general location where conventional coil springs would be located.

The air springs operate extremely well in the generally dirty environment of a rock crusher. As can be appreciated, there is a lot of abrasive dust produced in the crushing of rock, and the air springs are not adversely affected by these conditions. With this arrangement, the air springs can provide a tensioning force on the tension rods which is maintained in a desired range, while accommodating different operating positions of the moveable jaw and the cyclical movement of the jaw. The air springs accommodate to a hydraulic cylinder stroke of approximately 8 inches. The actual effective adjustment of the moveable jaw is normally about 7 inches to assure that there is a cushion of hydraulic oil between the piston and an end of the cylinder. The three stage air springs, which are shown, have proven quite satisfactory. The operating pressure of the air spring and the tank is 50 to 90 psi. More commonly, the operating range is 70 to 90 psi. The number of air springs and the size thereof are selected according to the structure and capacity of the particular jaw crusher. The tank associated with each air spring, has a volume at least two times, and preferrably two and one half times the volume of the air spring.

The air pressure tank 40 also includes controls for adjusting the air pressure. In this way the operator can, if necessary, adjust the pressure of the air springs at a position remote the tension rods during operation of the rock crusher. Furthermore, the tension force exerted by the air springs is not as sensitive to changes in length of the air spring relative to conventional springs. Each tank includes a pressure sensing arrangement 70 which can include warning signals if the sensing pressure is not in a desired range. A pressure relief valve can also be included.

The air spring arrangement has improved operating characteristics, allows adjustment during running of the rock crusher, is cost effective and extremely tolerant of the work environment.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A jaw crusher for crushing rock having a fixed jaw mounted on a frame and a movable jaw mounted on said frame and connected to a drive for cyclable movement of said movable jaw toward and away from said fixed jaw, said movable jaw and said fixed jaw adjacent a lower edge of said movable jaw being spaced and define a bite therebetween, said bite between said jaws being variable by adjusting a double acting hydraulic cylinder arrangement extending between the lower edge of said movable jaw and said frame, said hydraulic cylinder arrangement allowing movement of said movable jaw from a narrow bite position between said jaws to an open bite position which allows removal of obstructing material between said jaws, said jaw crusher further including a tensioning arrangement for biasing said movable jaw against said double acting hydraulic cylinder and accommodating the cyclable movement of said movable jaw, said tensioning arrangement including at least one tensioning rod having one end thereof connected to said lower edge of said movable jaw and an opposite end cooperating with a biasing member applying a tensile force on said at least one tensioning rod to bias said movable jaw, and wherein said biasing member is an air spring structure.

2. A jaw crusher as claimed in claim 1 wherein said air spring structure includes at least two air springs.

3. A jaw crusher as claimed in claim 2 wherein each air spring includes an auxiliary air pressure vessel connected to said air spring to modulate the operating pressure range of the air spring while accommodating the cyclable movement of said air spring in sympathy with the cyclable movement of said movable jaw.

4. A jaw crusher as claimed in claim 1 wherein said at least one tensioning rod is two spaced tensioning rods with the ends of said tensioning rods remote from said movable jaw being structurally connected by a common header, and wherein said air spring structure applies said bias to said tensioning rods using said common header as an intermediary transfer member.

5. A jaw crusher as claimed in claim 4 wherein said header includes a support arrangement accommodating movement of said header generally along the longitudinal axis of said tension rods and supporting said header against downward pivoting movement.

6. A jaw crusher as claimed in claim 5 wherein said air spring structure includes two side by side air springs acting on said header and located between said tension rods.

7. A jaw crusher as claimed in claim 6 wherein each of said air springs is connected to an air pressure supply having a volume equal to or greater than the volume of the air spring to modulate the operating pressure of the air spring.

8. A jaw crusher as claimed in claim 1 wherein said tensioning arrangement includes at least two air springs and each air spring includes a connected pressure supply tank to modulate the operating pressure of the air spring.

* * * * *